US005377384A

United States Patent [19]

Riegelman

[11] Patent Number: 5,377,384

[45] Date of Patent: Jan. 3, 1995

[54] LOCKING PIVOT SHOE

[76] Inventor: Harry M. Riegelman, 2417 Wimbledon Dr., Arlington, Tex. 76017

[21] Appl. No.: 42,967

[22] Filed: Apr. 5, 1993

[51] Int. Cl.[6] ..... E05F 3/00

[52] U.S. Cl. ..... 16/193; 49/181

[58] Field of Search ..... 16/193; 49/181

[56] References Cited

U.S. PATENT DOCUMENTS

| | | | |
|---|---|---|---|
| 4,590,708 | 5/1986 | Campodonico | 49/181 |
| 4,610,108 | 9/1986 | Marshik | 49/181 |
| 4,683,676 | 8/1987 | Steiner, Jr. | 49/181 |
| 4,718,194 | 1/1988 | FitzGibbon et al. | 49/181 |
| 4,958,462 | 9/1990 | Cross | 49/181 |

*Primary Examiner*—P. Austin Bradley
*Assistant Examiner*—Chuck Y. Mah
*Attorney, Agent, or Firm*—Robert A. Seemann

[57] ABSTRACT

A pivot shoe that includes a rotary barrel cam mounted in the body of the shoe, and a brake in the opening that is urged axially rearward by the barrel cam, has a radial protuberance and an axial slot with radial wall operating in interference between the brake and an inward facing wall of the opening for holding the shoe in the opening.

8 Claims, 5 Drawing Sheets

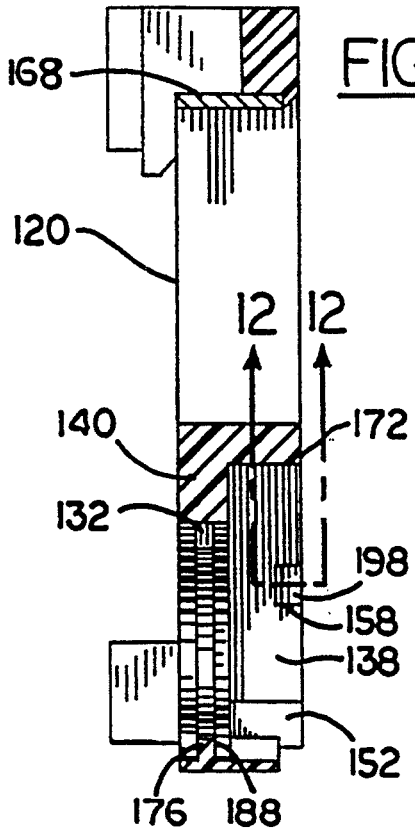
FIG. 7
FIG. 8
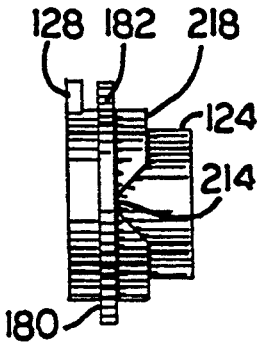
FIG. 9
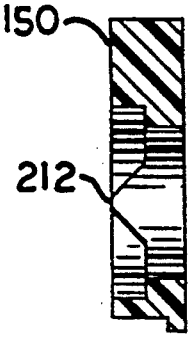

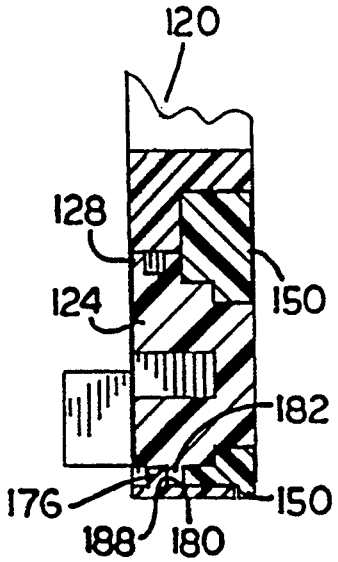
FIG. 10
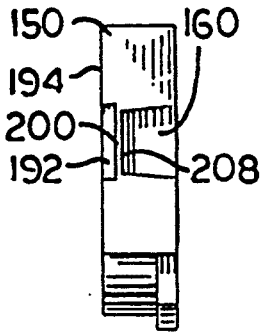
FIG. 11
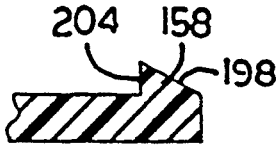
FIG. 12
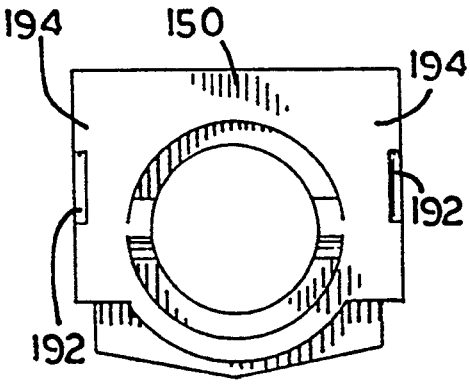
FIG. 13
FIG. 14
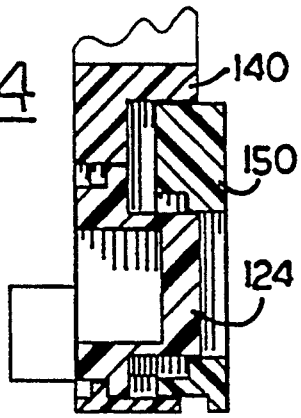

LOCKING PIVOT SHOE

BACKGROUND OF THE INVENTION

1. Field of the Invention

This invention pertains to movable closures, more specifically to a pivot shoe for mounting on a sliding window sash and in a track, for supporting the window sash at a desired height by bearing a brake shoe against the track when the window is rotated away from the track on the pivot shoe, thereby temporarily locking the window at the desired height. The shoe is designed for ease of assembly and installation.

2. Description of the Prior Art

One popular pivot shoe design comprises a rotating barrel cam which cams axially, radially, or both, to force one or more elements of the pivot shoe against the track in which the shoe slides as it supports the sash on a keyed shaft about which the sash rotates as the keyed shaft rotates the barrel cam.

The element forced against the track provides frictional braking resistance against movement of the pivot shoe along the track. The element so forced may be a flexible wall of the pivot shoe, a surface of the barrel cam, or a brake shoe that is moved within the walls of the pivot shoe by the barrel cam.

It is the integrity of the three piece assembly of the latter design, with which we are concerned. For example, in the prior art locking pivot shoe 24 shown in FIGS. 1–4, brake shoe 28, and barrel cam 30 together can fall out of opening 26 which is through body 40, when the barrel cam is set at 0 degree position 52 of body opening 26.

Retainer tab 46 at the front of the barrel cam keeps the assembly in the body when the barrel cam is rotated away from the 0 degree position 52 of body opening 26, except at 90 degree position 58 on opening 26, or at the 270 degree position, at which although the barrel cam is held in opening 26, brake shoe 28 can fall out of the opening.

In U.S. Pat. No. 4,610,108 patented Sep. 9, 1986 by G. Marshik, a locking pivot shoe has a barrel cam which forces serrated end portions of a U-shaped spring radially out into the track. The front of the barrel cam has a radial tab (36) which is received through a radial slot at the 0 degree position in the pivot shoe body opening so that the tab retains the barrel cam in the body at all positions other than that of the slot.

In U.S. Pat. No. 4,718,194, patented Jan. 12, 1988 by FitzGibbon et al., the barrel cam of the pivot shoe has a collar at the front and a radial tab at the back. The barrel cam is inserted at the front of the pivot shoe into an opening in the pivot shoe body. The tab passes through a vertical slot at the 0 degree position of the opening. The tab holds the barrel cam in the body at all positions but for the 0 degree position.

In U.S. Pat. No. 4,683,676, patented by Sterner, Jr. on Aug. 4, 1987, the barrel cam of the balance shoe has a retention lug or pin (62) which engages an annular slot in the body of the balance shoe except for a space between the right and left side of the split body at the 0 degree position of the opening formed in the body by the Left and right sides for receiving the barrel cam. The retention lug holds the barrel cam in the body for all positions but the 0 degree position.

In U.S. Pat. No. 4,590,708 patented by Campodonico on May 27, 1986, the barrel cam which slides into an opening in the pivot shoe has an annular groove that receives a bulge or pin (48) extending inwardly from the inner diameter of the opening. The pin and groove arrangement assures that the barrel cam does not unduly move axially out of the opening but for two rotational positions of the barrel cam when the groove clears the pin.

In U.S. Pat. No. 4,958,462 patented by Cross on Sep. 25, 1990, the barrel cam is prevented from forward exiting the opening in the barrel cam body by annular axial cam faces which engage mating axial cam faces in the body surrounding the opening. The barrel cam is prevented from rearward exiting the opening by a brake shoe which is driven by the rear end face of the barrel cam as the barrel cam is driven axially by the mating annular axial cam faces. The brake shoe has forward extending legs which snap into holes in the body within the opening, and thereby retains the barrel cam in the body by way of the contact with the rear end face of the barrel cam.

It is an object of the present invention to provide a locking pivot shoe which stays an integral unit after assembly of the camming elements and brake shoe in the pivot shoe body regardless of the rotary position of the barrel cam.

It is another object of the invention to provide a locking pivot shoe in which the brake shoe contributes to the long time integrity of the assembled unit.

It is another object of the invention to provide a locking pivot shoe which snaps into integral assembly without having to rotate the barrel cam to a new position after the barrel cam is fully inserted.

It is another object in the locking pivot shoe that the brake can be assembled on to the barrel cam by axial movement regardless of the rotatory position of the barrel cam.

It is another object of the invention that the brake is driven by direct camming action between the barrel cam and the brake.

It is still another object that the barrel cam, when at the 0 degree slotted position, be held in the locking pivot shoe body by the brake.

Another object of the invention is that the brake be held in the body opening by a partial axial interference fit between the brake and a wall of the opening.

A further object is that the above partial axial interference fit be between a protuberance and end wall of an axial groove for receiving the protuberance.

Other objects and advantages of the invention will become apparent to persons skilled in the art from the ensuing description.

Briefly, a locking pivot shoe body includes an opening through the body from the front of the body to the back of the body. A rotary barrel cam is mounted in the opening for rotation on an axis which passes through the front and the back of the body with the front of the barrel cam being toward the front of the body.

A brake shoe is mounted on the body for axial movement within the opening. The brake shoe is adapted for engaging the barrel cam for being urged by the barrel cam for the axial movement.

Means on the body for holding the brake shoe in the opening comprises an interference fit between the brake shoe and the inner facing surface of the wall of the opening, by a radial protuberance and an axially oriented groove for receiving the protuberance.

In one arrangement of the invention, the protuberance is on the inner facing surface of the opening wall, and the groove is on the brake shoe. The groove is open toward the rear of the brake, and includes a radial wall toward the front end of the brake shoe for engaging the protuberance and for limiting rearward excursion of the brake shoe.

BRIEF DESCRIPTION OF THE DRAWINGS

In order that the invention be more fully comprehended, it will now be described, by way of example, with reference to the accompanying drawings, in which:

FIGS. 5–14 are of the present invention.

FIG. 1 is a front view of a Prior Art pivot shoe

FIG. 2 is a rear view of the Prior Art pivot show shown in FIG. 1.

FIG. 3 is a cross section view of the Prior Art pivot shoe shown in FIG. 2.

FIG. 4 is a side view of the barrel cam of the Prior Art brake shoe shown in FIGS. 1, 2 and 3, with the barrel cam rotated 90 degrees from the position of the barrel cam in FIG. 3.

FIG. 5 is a front view of a pivot shoe according to the present invention.

FIG. 6 is a rear view of tile pivot shoe shown in FIG. 5.

FIG. 7 is a cross section side view of the body of the pivot shoe shown in FIG. 5 viewed at 7—7.

FIG. 8 is a side view of the bevel cam of the pivot shoe shown in FIG. 5.

FIG. 9 is a cross section side view of the brake shoe of the pivot shoe shown in FIG. 6, viewed at 9—9.

FIG. 10 is a cross section side view of the pivot shoe assembly shown in FIG. 5, viewed at 7—7.

FIG. 11 is a side view of the brake shoe shown in FIG. 13.

FIG. 12 is a partial section view of a beveled retainer post in FIG. 7, viewed at 12—12.

FIG. 13 is a front view of the brake shoe shown in FIG. 11.

FIG. 14 is a cross section side view of the pivot shoe of FIG. 5, viewed at 7—7, when the barrel cam is rotated 90 degrees from the position at which it is shown in FIGS. 5, 8 and 10.

DESCRIPTION OF THE PREFERRED EMBODIMENTS

Figure 1:
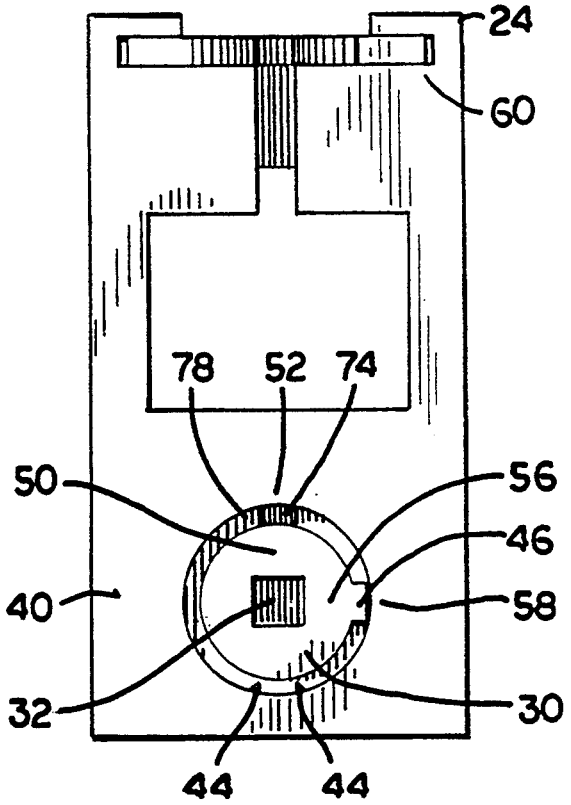
FIG. 1 PRIOR ART
FIGS. 1–4 are of prior art.
Figure 2:
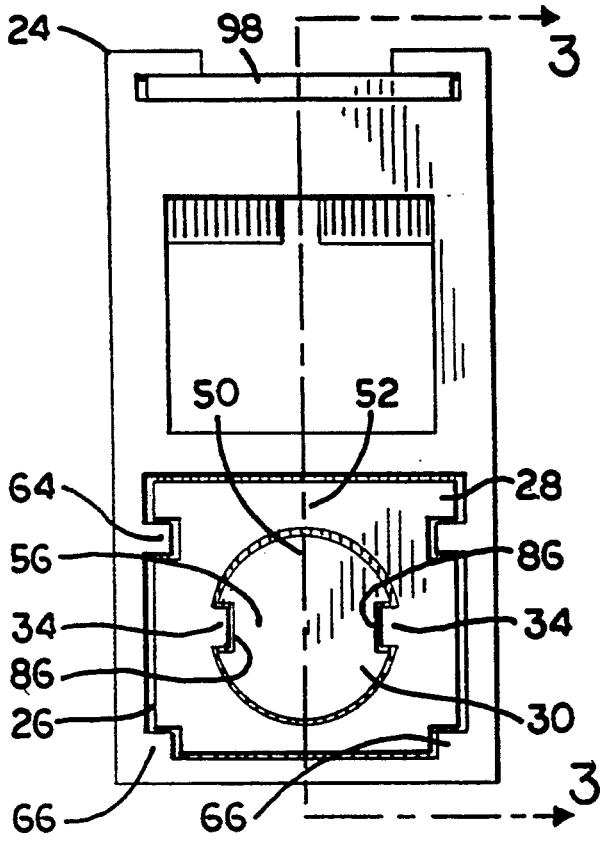
FIG. 2 PRIOR ART

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to prior art FIGS. 1–4, in FIG. 1 showing pivot shoe 24, barrel cam 30 in opening 26 of body 40 of shoe 24 is rotated in a manner common to the window art via keyway 32 by a key or bar extension of the window (not shown) as the window is rotated into and out of the track.

Figure 3:
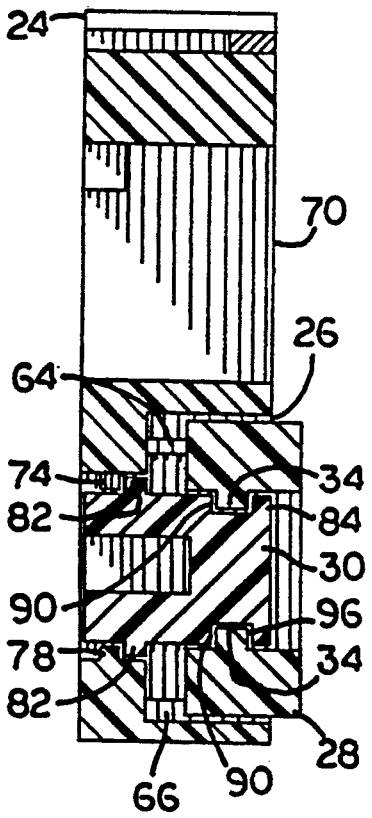
FIG. 3 PRIOR ART

FIG. 1 shows barrel cam 30 rotated to a position in which retainer tab 46 is at the 90 degree position 58 of opening 26. This position, and one with the tab 180 degrees about, are the positions in which the cam drives brake shoe 28 to maximum extension from body 40, as shown in FIG. 3.

In order to assemble the elements of the pivot shoe, barrel cam 30 is inserted into opening 26 from the back side 70 of the body. Tab 46 passes forward through slot 74 in annular ring 78 only when retainer tab is rotated to the 0 degree position of opening 26.

When barrel cam 30 is fully seated in opening 26 at this angular position, with barrel cam annular ring 82 against ring 78, the barrel cam is then rotated away from the 0 degree position so that retainer tab 46 moves in front of body ring 78 thereby retaining the barrel cam in opening 26. The barrel cam is then rotated to a 90 degree position or to a 270 degree position so that shoe 28 can be installed in opening 26 around barrel cam 30.

Brake shoe 28 is inserted axially from the back side 70 of body 40, into opening 26. Shoe 28 slides axially along axially oriented ridges 64 and 66 which run in opening 26 from the back of the body to the maximum forward slidable position of opening 26. Shoe 28 passes in about barrel cam 30 which receives brake shoe 28 cam follower posts 34 through retainer ring 84 via receiver slots 86 through ring 84. Slots 86 are in proper rotational position for receiving the posts only when the cam is at 90 or 270 degrees.

Then the cam is rotated away from the 90 or 270 degree position, to any position but the zero degree position so that the cam follower posts 34 are in front of retainer ring 84 thus holding brake shoe 28 in opening 26 on cam 30, and tab 46 is away from opening 26.

FIG. 3 shows barrel cam 30 rotated to a 90 degree position. Brake shoe 28 is cammed to maximum extension from body 40 by camming action of driving surface 90 of the cam against cam follower posts 34 as the posts ride in cam groove 38, holding brake shoe 28 in opening 26 by means of the posts held in cam 30. Retainer tab 46 is rotated out of sight.

Figure 4:
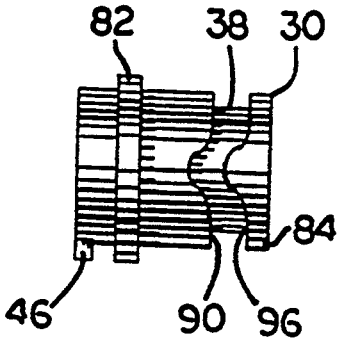
FIG. 4 PRIOR ART

FIG. 4 shows barrel cam 30 at the 180 degree position. For shipping, cam 30 is rotated to the 180 degree position in order to hold the pivot shoe assembly together during shipping. At the 180 degree position of the barrel cam, retainer tab 46 locates between detent ribs 44. This keeps the barrel cam from undesirable rotation during shipping. It is also the position in which brake shoe 28 is drawn to the maximum into the shoe by cam contour retaining surface 96 of retaining ring 84.

The top portion 60 of locking pivot shoe 24 includes a plate 98 for receiving a window balance spring. This is characteristic of pivot shoe assemblies in the art and is not discussed further here.

A locking pivot shoe that is similar to that described in FIGS. 1–4 is available as model 16T125 from Caldwell Manufacturing Company, located at 2605 Manitou Road, Rochester, N.Y. 14692-8891.

The present invention will now be described with reference to remaining FIGS. 5–14.

Figure 5:
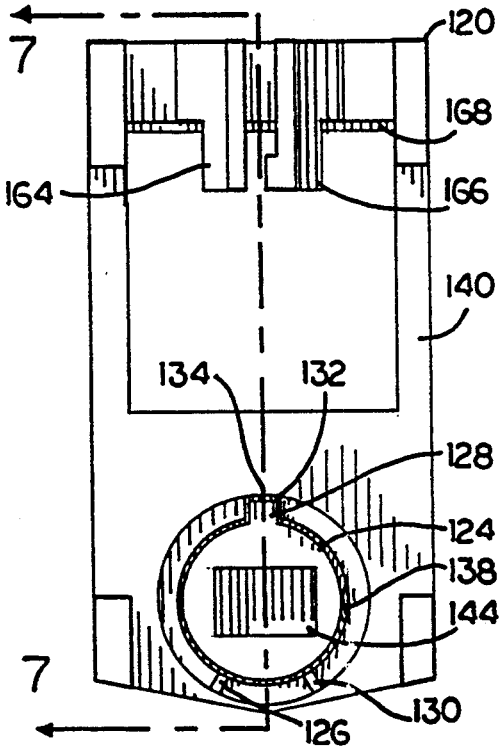

Referring to FIG. 5, locking pivot shoe 120 includes barrel cam 124 shown with index tab 128 in slot 132 at 0 degree position 134 of opening 138 in body 140.

Keyway 144 in the front end of barrel cam 124 is designed to receive a window pivot shaft (not shown) which extends from one end of the window for supporting the window, as the pivot shoe rides in a window frame track. Keyway 144 is also for being turned by the window pivot shaft as the other end of the window is rotated into and out of the track.

Index tab 128 is rotated to a position between detent ribs 126 and 130 for shipping, to provide the user with keyway 144 prealigned for receiving a window pivot shaft.

Figure 6:
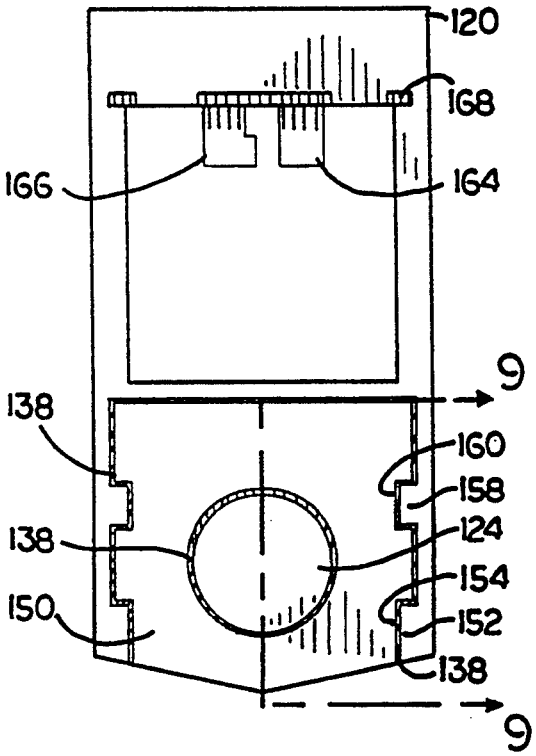

In locking pivot shoe 120 shown from the rear in FIG. 6, brake shoe 150 moves axially in opening 138 on two guides, axially oriented ridge 152 which is received by axial groove 154, and beveled retainer post 158 which is received by axial groove 160 in brake shoe 150.

The top portion of locking pivot shoe 120 includes hooks 164, 166, and plate 168 for receiving a window balance spring.

Referring now to FIGS. 7–13, barrel cam 124 and brake shoe 150 are assembled in opening 138 by inserting barrel cam 124 into the opening from back side 172 of body 140, with index tab 128 aligned for the 0 degree position 134 in opening 138 so that the tab passes through slot 132 and is forward of annular ring 176 on body 140 when forward bearing planar surface 180 of annular ring 182 on barrel cam 124 seats against rear bearing planar surface 188 of ring 176.

Regardless of the angular position of barrel cam 124 fully seated in opening 138, brake shoe 150 is simply pressed with no interference caused by the barrel cam, into opening 138.

If desired, brake shoe 150 and barrel cam 124 can be pressed into opening 138 at the same time as long as tab 128 of the barrel cam is oriented to the 0 degree position. However, it is easier to install barrel cam 124 first, aligned to the 0 degree position, then snap in brake shoe 150 into opening 138.

Referring to FIGS. 7, 11, 12, and 13, during insertion of brake shoe 150 into opening 138, beveled surface 192 on the front edge 194 of shoe 150 engages beveled surface 198 on beveled retainer post 158 mounted on an inner facing side wall of opening 138.

This engagement makes an interference fit between the brake shoe and the side walls of opening 138. Continuing insertion pressure on the brake shoe results in yielding between the elements in interference until reduced-width portion 200 of brake shoe 150 passes forward of post 158, whereby brake shoe 150 is prevented from leaving opening 138 by reduced width sidewall portion portion 200 being forward of post 158.

Preferably front surface 204 of retainer post or suitable protuberance 158 is normal to the axial movement of insertion in order to provide good resistance against rear facing surface 208 of portion 200, to prevent removal of the shoe from the opening.

It is also within the contemplation of the invention that the protuberance be on the brake shoe, and the axial groove in which the protuberance moves be in a wall of the opening.

Thus, in the present invention as described above, the brake shoe which contributes to the long time integrity of the assembled unit may be assembled by axial movement on to the barrel cam regardless of the rotary position of the seated barrel cam.

All elements of the locking pivot shoe can be assembled with the barrel cam at one rotary position, without need to rotate the barrel cam to effect complete assembly.

The locking pivot shoe stays an integrally assembled unit after assembly of the camming elements and the brake shoe regardless of the rotary position of the barrel cam.

The locking brake shoe is easily assembled by inserting the barrel cam into the opening in the body from the back of the body until a planar annular ring face on the barrel cam bears on a planar annular face of a ring of a wall of the opening, and without rotating the barrel cam, inserting the brake shoe into the opening until the brake shoe passes an interference fit between the brake shoe and an inward facing surface of the wall which forms the opening in the body.

When barrel cam 124 is at 0 degrees as shown in FIG. 8, or at 180 degrees, brake shoe 150 is free to rest anywhere between a fully withdrawn position as shown in FIG. 10, or to be fully extended rearwardly from body 140 as shown in FIG. 14. The portion of barrel cam 124 that is rearward of cam surface 214/218 offers no resistance to rearward movement of brake shoe 150 on the barrel cam. Rearward movement of brake shoe 150 is limited only by engagement of, surface 208 with surface 204, as groove 160 moves back on post 158. High cam surface 212 of brake shoe 150 aligns with low-cam surface 214 of barrel cam 124, permitting the excursion or axial range of free movement for the brake shoe.

Referring to FIGS. 8, 14 and 9, when barrel cam 124 is at the 90 or 270 degree positions as in FIG. 14, barrel cam 124 high-cam surface 218 engages brake shoe 150 high-cam surface 212, forcing brake shoe 150 to the maximum rearward position of FIG. 14.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. In an improved locking pivot shoe comprising, a body having a front and a back, an opening through said body from the front to the back of said body, a wall around said opening including an inward facing surface forming said opening, a rotary barrel cam having a front and a back, mounted in said opening for rotation on an axis which passes through the front and back of said body with the front of said barrel cam being toward the front of said body, a brake shoe mounted on said body for axial movement within said opening and being adapted for engaging said barrel cam for being urged by said barrel cam for said axial movement, the improvement comprising:

means on one of said body and brake shoe for preventing rearward removal of said brake shoe from said opening, said means being a bevel and adjacent radial wall with axially facing retainer surface, said bevel being adapted so that there is increasing radial force interference fit between said brake shoe and said inward facing surface of said opening in said body upon progressive insertion of said brake shoe in said opening, said axially facing retainer surface being adapted for engagement between said brake shoe and said body within said opening that limits rearward movement of said brake shoe for said preventing of rearward removal.

2. The locking pivot shoe described in claim 1, further comprising:

said bevel and adjacent radial wall comprising a radial protuberance on said inward facing surface.

3. The locking pivot shoe described in claim 2, further comprising:

an axially oriented groove (160) on said brake shoe adapted for receiving said radial protuberance of said means for preventing rearward removal of said brake shoe.

4. The locking pivot shoe described in claim 3, further comprising:

said axially oriented groove on said brake shoe being open toward the rear of said brake shoe and having a radial wall across said groove, toward the front end of said groove, adapted for engaging said protuberance for limiting the rearward excursion of said brake shoe.

5. In an improved locking pivot shoe comprising, a body having a front and a back an opening through said body from the front to the back of said body, a wall around said opening including an inward facing surface forming said opening, a rotary barrel cam having a front and a back, mounted in said opening for rotation on an axis which passes through the front and back of said body with the front of said barrel cam being toward the front of said body, a brake shoe mounted on said body for axial movement within said opening and being adapted for engaging said barrel cam for being urged by said barrel cam for said axial movement, the improvement comprising:

means on said body for holding said brake shoe in said opening, said wall of said opening comprising a first annular ring normal to said axis, said barrel cam comprising a second annular ring normal to the axis of said barrel cam, said first ring having a first rearward facing planar surface, and said second ring having a second forward facing planar surface, said first and second planar surfaces being in bearing contact when said barrel cam is fully seated in said opening from the back of said body, said second ring including a third rearward facing cam surface for said urging of said brake shoe in said opening in axially rearward movement.

6. The locking pivot shoe described in claim 5, further comprising:

said means on said body for holding said brake shoe in said opening being interference fit means between said brake shoe and an inward facing surface of said wall forming said opening in said body.

7. The locking pivot shoe described in claim 5, further comprising: said barrel cam being adapted for unrestricted rearward movement of said brake shoe on said barrel cam, rearward excursion of rearward movement of said brake shoe in said opening being limited by said means on said body for holding said brake shoe in said opening, said means for holding being interference fit means between said brake shoe and an inward facing surface of said wall forming said opening in said body.

8. The locking pivot shoe described in claim 7, further comprising:

said interference fit means comprising a radial protuberance on a one of said brake shoe and said inward facing surface, and an axially oriented groove on the other of said brake shoe and said inward facing surface, for receiving said radial protuberance.

* * * * *